US009935376B2

(12) United States Patent
Pietraski et al.

(10) Patent No.: US 9,935,376 B2
(45) Date of Patent: Apr. 3, 2018

(54) ANTENNA REFLECTOR SYSTEM

(71) Applicant: IDAC HOLDINGS, INC., Wilmington, DE (US)

(72) Inventors: Philip J. Pietraski, Jericho, NY (US); Robert A. DiFazio, Greenlawn, NY (US); Robert L. Olesen, Huntington, NY (US)

(73) Assignee: IDAC HOLDINGS, INC., Wilmington, DE (US)

( * ) Notice: Subject to any disclaimer, the term of this patent is extended or adjusted under 35 U.S.C. 154(b) by 535 days.

(21) Appl. No.: 14/575,302

(22) Filed: Dec. 18, 2014

(65) Prior Publication Data

US 2015/0180120 A1 Jun. 25, 2015

Related U.S. Application Data

(60) Provisional application No. 61/918,448, filed on Dec. 19, 2013.

(51) Int. Cl.

| | |
|---|---|
| ***H01Q 3/00*** | (2006.01) |
| ***H01Q 15/00*** | (2006.01) |
| ***H01Q 15/08*** | (2006.01) |
| ***H01Q 15/14*** | (2006.01) |
| ***H01Q 19/19*** | (2006.01) |
| *H01Q 3/18* | (2006.01) |
| *H01Q 3/16* | (2006.01) |

(52) U.S. Cl.

CPC ..... *H01Q 15/0086* (2013.01); *H01Q 15/08* (2013.01); *H01Q 15/14* (2013.01); *H01Q 19/191* (2013.01); *H01Q 3/16* (2013.01); *H01Q 3/18* (2013.01)

(58) Field of Classification Search

CPC .... H01Q 15/0086; H01Q 15/08; H01Q 15/14; H01Q 15/148; H01Q 3/18; H01Q 3/22; H01Q 3/16; H01Q 3/12

USPC ..... 342/368, 372, 373; 343/755, 777, 779

See application file for complete search history.

(56) References Cited

U.S. PATENT DOCUMENTS

| | | | | |
|---|---|---|---|---|
| 4,298,877 A * | 11/1981 | Sletten | ..... | H01Q 1/1264 343/781 CA |
| 4,460,897 A * | 7/1984 | Gans | ..... | H01Q 3/42 333/238 |
| 5,033,833 A * | 7/1991 | Brown | ..... | G02B 13/06 359/725 |
| 6,204,822 B1 * | 3/2001 | Cardiasmenos | ..... | H01Q 3/18 343/757 |

(Continued)

OTHER PUBLICATIONS

Boardman et al., "Active and Tunable Metamaterials," Laser Photonics Rev., pp. 1-21 (2010).

(Continued)

*Primary Examiner* — Chuong P Nguyen

(74) *Attorney, Agent, or Firm* — Volpe and Koenig, P.C.

(57) ABSTRACT

A scan range of a steerable antenna is extended using a reflecting surface or surfaces within the scan range. Various implementations may also include lenses, and the reflecting surface, lenses, or both may include meta-materials. The antenna may be steered to interact with the reflecting surface, lenses, or both to reflect the beam in a direction not possible using the antenna alone. The scan range may be extended in azimuth, elevation, or both, and beam pattern, and antenna freespace impedance may be controlled.

20 Claims, 11 Drawing Sheets

(56) References Cited

U.S. PATENT DOCUMENTS

| | | | | |
|---|---|---|---|---|
| 6,492,955 | B1 * | 12/2002 | Amyotte | H01Q 3/20 343/755 |
| 7,411,561 | B1 * | 8/2008 | Baldauf | H01Q 19/192 343/761 |
| 7,932,868 | B2 * | 4/2011 | Legay | H01Q 1/288 343/761 |
| 8,134,513 | B2 * | 3/2012 | Karaoguz | H01Q 1/1257 343/757 |
| 8,350,777 | B2 * | 1/2013 | Morton | H01Q 1/42 343/872 |
| 2008/0112065 | A1 * | 5/2008 | Wo | G02B 26/101 359/727 |
| 2012/0154239 | A1 | 6/2012 | Bar-Sade et al. | |
| 2016/0294472 | A1 * | 10/2016 | Palmer | H04B 10/116 |
| 2017/0040684 | A1 * | 2/2017 | Turner | H01Q 3/20 |

OTHER PUBLICATIONS

Engheta, "Thin absorbing screens using metamaterial surfaces," IEEE Antennas and Propagation Society International Symposium, vol. 2, pp. 392-395 (2002).

IEEE P802. 11ad-2012, IEEE Standard for Information Technology—Telecommunications and Information Exchange Between Systems—Local and Metropolitan Area Networks—Specific Requirements—Part 11: Wireless LAN Medium Access Control (MAC) and Physical Layer (PHY) Specifications—Amendment 3: Enhancements for Very High Throughput in the 60 GHz Band, IEEE P802.11ad-2012 (Oct. 2012).

Liang et al., "A 3-D Luneburg Lens Antenna Fabricated by Polymer Jetting Rapid Prototpying," IEEE Transactions on Antennas and Propagation, vol. 62, No. 4 (Apr. 2014).

Liang et al., "Broadband Electronically Beam Scanning Structure Using Luneburg Lens," 2013 IEEE MTT-S International Microwave Symposium Digest (IMS), pp. 103 (2013).

Liu et al., "Study of Antenna Superstrates Using Metamaterials for Directivity Enhancement Based on Fabry-Perot Resonant Cavity," International Journal of Antennas and Propagation, Hindawi Publishing Corporation, pp. 1-10 (Jan. 2013).

Mosallaei et al, "Engineered Meta-Substrates for Antenna Miniaturization," URSI EMTS, pp. 191-193 (2004).

Nishiyama et al., "Polarization Controlled Microstrip Antenna," 2005 IEEE Antennas and Propagation Society International Symposium, vol. 1A, pp. 68-71 (Jul. 3-8, 2005).

Tsakmakidis et al., "Negative-permeability electromagnetically induced transparent and magnetically active metamaterials," Physical Review B 81, 195128 (2010).

Vubiq, "HaulPass™ SC, Carrier grade Dual-Band Small Cell Backhaul Auto-Aligning," VublQ, Inc., pp. 1-3 downloaded Oct. 11, 2013.

Yirka, "Research team develops method to produce large sheets of metamaterials," (Jun. 15, 2011) available at http://phys.org/news/2011-06-team-methed-large-sheets-metamaterials.html (last visited Mar. 16, 2015).

* cited by examiner

ANTENNA REFLECTOR SYSTEM

CROSS REFERENCE TO RELATED APPLICATIONS

This application claims the benefit of U.S. Provisional Application No. 61/918,448, filed Dec. 19, 2013, the contents of which are hereby incorporated by reference herein.

BACKGROUND

With the allocation of a large amount of spectrum in the millimeter wave (mmW) range as an unlicensed band (e.g. the 60 Giga Hertz (GHz) band), there has been an explosion of activity to exploit both the huge amount of spectrum and its unlicensed nature. There is a great deal of harmonization of the 60 GHz band, but current regulations for the band place various limits on transmission (Tx) power, equivalent isotropically radiated power (EIRP), and other parameters. The Tx power limits are generally low. Even without low Tx power limits, it is still beneficial to operate at low power since high powered power amplifiers (PAs) in the mmW region can be expensive. To overcome the Tx power limits, high gain antennas, which typically focus in a limited range of direction from the antenna, may be used, for example in the Institute of Electrical and Electronics Engineers (IEEE) 802.11ad specifications. The low cost planar array antennas envisioned in IEEE 802.11ad and those currently used in WirelessHD™ devices may suffer from limited steering range, for example +/−45°. This range may be further reduced if passive sub-arrays for increasing array gain are used.

Multiple local area network (LAN) and personal area (PAN) standards for 60 GHz band have been created, including IEEE 802.11ad. Such standards may use channels that are approximately 2 GHz wide within the 60 GHz band, for example. The number of channels available may vary by region, for example, 2-4 channels.

For mobile devices that can operate over non-line-of-sight (NLOS) paths, a 360° directional coverage may not be needed, although benefits may be realized with increased coverage. For access points and backhaul applications, greater coverage up to 360° may be needed. This may be satisfied by use of multiple arrays or fixed antennas that each have partial coverage, but provide full coverage when combined provide. Alternatively, mechanical actuators may be used to either physically steer the array or physically move a reflector. Both VubIQ© and BridgeWave© have mmW antenna systems that employ mechanical movements to either move the antenna or move a reflector.

SUMMARY

In an antenna system, reflectors and/or lenses may be positioned in a local region around a phase array antenna (PAA) such that the main lobe of the PAA with limited scan range may be steered to transform its narrow beam direction and/or shape beyond its capabilities up to full 360 degree coverage.

BRIEF DESCRIPTION OF THE DRAWINGS

A more detailed understanding may be had from the following description, given by way of example in conjunction with the accompanying drawings wherein.

DETAILED DESCRIPTION

Figure 1A:
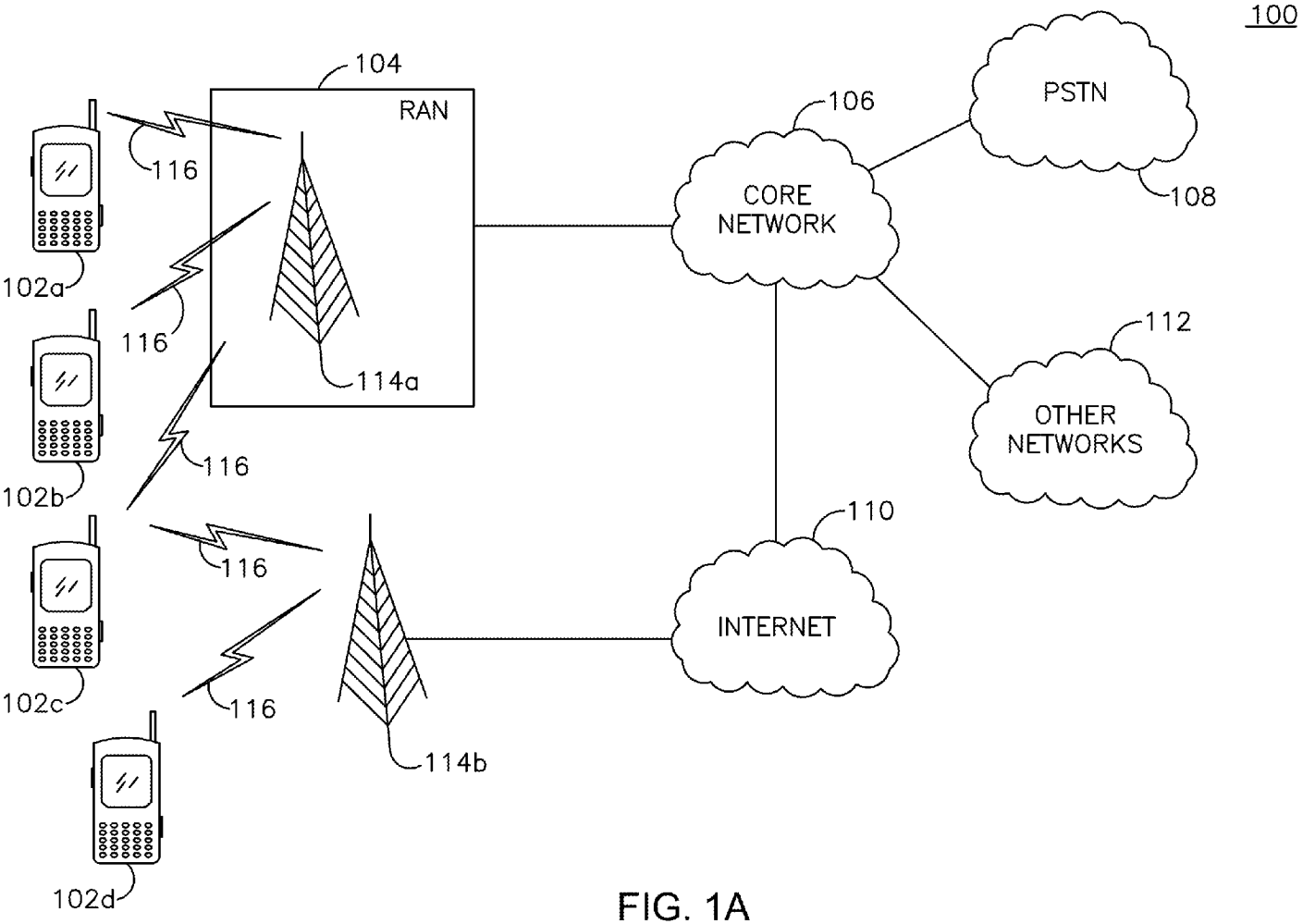
FIG. 1A is a system diagram of an example communications system in which one or more disclosed embodiments may be implemented.

FIG. 1A is a diagram of an example communications system 100 in which one or more disclosed embodiments may be implemented. The communications system 100 may be a multiple access system that provides content, such as voice, data, video, messaging, broadcast, etc., to multiple wireless users. The communications system 100 may enable multiple wireless users to access such content through the sharing of system resources, including wireless bandwidth. For example, the communications systems 100 may employ one or more channel access methods, such as code division multiple access (CDMA), time division multiple access (TDMA), frequency division multiple access (FDMA), orthogonal FDMA (OFDMA), single-carrier FDMA (SC-FDMA), and the like.

As shown in FIG. 1A, the communications system 100 may include wireless transmit/receive units (WTRUs) 102*a*, 102*b*, 102*c*, 102*d*, a radio access network (RAN) 104, a core network 106, a public switched telephone network (PSTN) 108, the Internet 110, and other networks 112, though it will be appreciated that the disclosed embodiments contemplate any number of WTRUs, base stations, networks, and/or network elements. Each of the WTRUs 102*a*, 102*b*, 102*c*, 102*d* may be any type of device configured to operate and/or communicate in a wireless environment. By way of example, the WTRUs 102*a*, 102*b*, 102*c*, 102*d* may be configured to transmit and/or receive wireless signals and may include user equipment (UE), a mobile station, a fixed or mobile subscriber unit, a pager, a cellular telephone, a personal digital assistant (PDA), a smartphone, a laptop, a netbook, a personal computer, a wireless sensor, consumer electronics, and the like.

The communications systems 100 may also include a base station 114*a* and a base station 114*b*. Each of the base stations 114*a*, 114*b* may be any type of device configured to wirelessly interface with at least one of the WTRUs 102*a*, 102*b*, 102*c*, 102*d* to facilitate access to one or more communication networks, such as the core network 106, the Internet 110, and/or the other networks 112. By way of example, the base stations 114*a*, 114*b* may be a base transceiver station (BTS), a Node-B, an eNode B, a Home Node B, a Home eNode B, a site controller, an access point (AP), a wireless router, and the like. While the base stations 114*a*, 114*b* are each depicted as a single element, it will be appreciated that the base stations 114*a*, 114*b* may include any number of interconnected base stations and/or network elements.

The base station 114*a* may be part of the RAN 104, which may also include other base stations and/or network elements (not shown), such as a base station controller (BSC), a radio network controller (RNC), relay nodes, etc. The base station 114*a* and/or the base station 114*b* may be configured to transmit and/or receive wireless signals within a particular geographic region, which may be referred to as a cell (not shown). The cell may further be divided into cell sectors. For example, the cell associated with the base station 114*a* may be divided into three sectors. Thus, in one embodiment, the base station 114*a* may include three transceivers, i.e., one for each sector of the cell. In another embodiment, the base station 114*a* may employ multiple-input multiple-output (MIMO) technology and, therefore, may utilize multiple transceivers for each sector of the cell.

The base stations 114*a*, 114*b* may communicate with one or more of the WTRUs 102*a*, 102*b*, 102*c*, 102*d* over an air interface 116, which may be any suitable wireless communication link (e.g., radio frequency (RF), microwave, infrared (IR), ultraviolet (UV), visible light, etc.). The air interface 116 may be established using any suitable radio access technology (RAT).

More specifically, as noted above, the communications system 100 may be a multiple access system and may employ one or more channel access schemes, such as CDMA, TDMA, FDMA, OFDMA, SC-FDMA, and the like. For example, the base station 114*a* in the RAN 104 and the WTRUs 102*a*, 102*b*, 102*c* may implement a radio technology such as Universal Mobile Telecommunications System (UMTS) Terrestrial Radio Access (UTRA), which may establish the air interface 116 using wideband CDMA (WCDMA). WCDMA may include communication protocols such as High-Speed Packet Access (HSPA) and/or Evolved HSPA (HSPA+). HSPA may include High-Speed Downlink Packet Access (HSDPA) and/or High-Speed Uplink Packet Access (HSUPA).

In another embodiment, the base station 114*a* and the WTRUs 102*a*, 102*b*, 102*c* may implement a radio technology such as Evolved UMTS Terrestrial Radio Access (E-UTRA), which may establish the air interface 116 using Long Term Evolution (LTE) and/or LTE-Advanced (LTE-A).

In other embodiments, the base station 114*a* and the WTRUs 102*a*, 102*b*, 102*c* may implement radio technologies such as IEEE 802.16 (i.e., Worldwide Interoperability for Microwave Access (WiMAX)), CDMA2000, CDMA2000 1×, CDMA2000 EV-DO, Interim Standard 2000 (IS-2000), Interim Standard 95 (IS-95), Interim Standard 856 (IS-856), Global System for Mobile communications (GSM), Enhanced Data rates for GSM Evolution (EDGE), GSM EDGE (GERAN), and the like.

The base station 114*b* in FIG. 1A may be a wireless router, Home Node B, Home eNode B, or access point, for example, and may utilize any suitable RAT for facilitating wireless connectivity in a localized area, such as a place of business, a home, a vehicle, a campus, and the like. In one embodiment, the base station 114*b* and the WTRUs 102*c*, 102*d* may implement a radio technology such as IEEE 802.11 to establish a wireless local area network (WLAN). In another embodiment, the base station 114*b* and the WTRUs 102*c*, 102*d* may implement a radio technology such as IEEE 802.15 to establish a wireless personal area network (WPAN). In yet another embodiment, the base station 114*b* and the WTRUs 102*c*, 102*d* may utilize a cellular-based RAT (e.g., WCDMA, CDMA2000, GSM, LTE, LTE-A, etc.) to establish a picocell or femtocell. As shown in FIG. 1A, the base station 114*b* may have a direct connection to the Internet 110. Thus, the base station 114*b* may not be required to access the Internet 110 via the core network 106.

The RAN 104 may be in communication with the core network 106, which may be any type of network configured to provide voice, data, applications, and/or voice over internet protocol (VoIP) services to one or more of the WTRUs 102*a*, 102*b*, 102*c*, 102*d*. For example, the core network 106 may provide call control, billing services, mobile location-based services, pre-paid calling, Internet connectivity, video distribution, etc., and/or perform high-level security functions, such as user authentication. Although not shown in FIG. 1A, it will be appreciated that the RAN 104 and/or the core network 106 may be in direct or indirect communication with other RANs that employ the same RAT as the RAN 104 or a different RAT. For example, in addition to being connected to the RAN 104, which may be utilizing an E-UTRA radio technology, the core network 106 may also be in communication with another RAN (not shown) employing a GSM radio technology.

The core network 106 may also serve as a gateway for the WTRUs 102*a*, 102*b*, 102*c*, 102*d* to access the PSTN 108, the Internet 110, and/or other networks 112. The PSTN 108 may include circuit-switched telephone networks that provide plain old telephone service (POTS). The Internet 110 may include a global system of interconnected computer networks and devices that use common communication protocols, such as the transmission control protocol (TCP), user datagram protocol (UDP) and the internet protocol (IP) in the TCP/IP internet protocol suite. The networks 112 may include wired or wireless communications networks owned and/or operated by other service providers. For example, the networks 112 may include another core network connected to one or more RANs, which may employ the same RAT as the RAN 104 or a different RAT.

Some or all of the WTRUs 102*a*, 102*b*, 102*c*, 102*d* in the communications system 100 may include multi-mode capabilities, i.e., the WTRUs 102*a*, 102*b*, 102*c*, 102*d* may include multiple transceivers for communicating with different wireless networks over different wireless links. For example, the WTRU 102*c* shown in FIG. 1A may be configured to communicate with the base station 114*a*, which may employ a cellular-based radio technology, and with the base station 114*b*, which may employ an IEEE 802 radio technology.

Figure 1B:
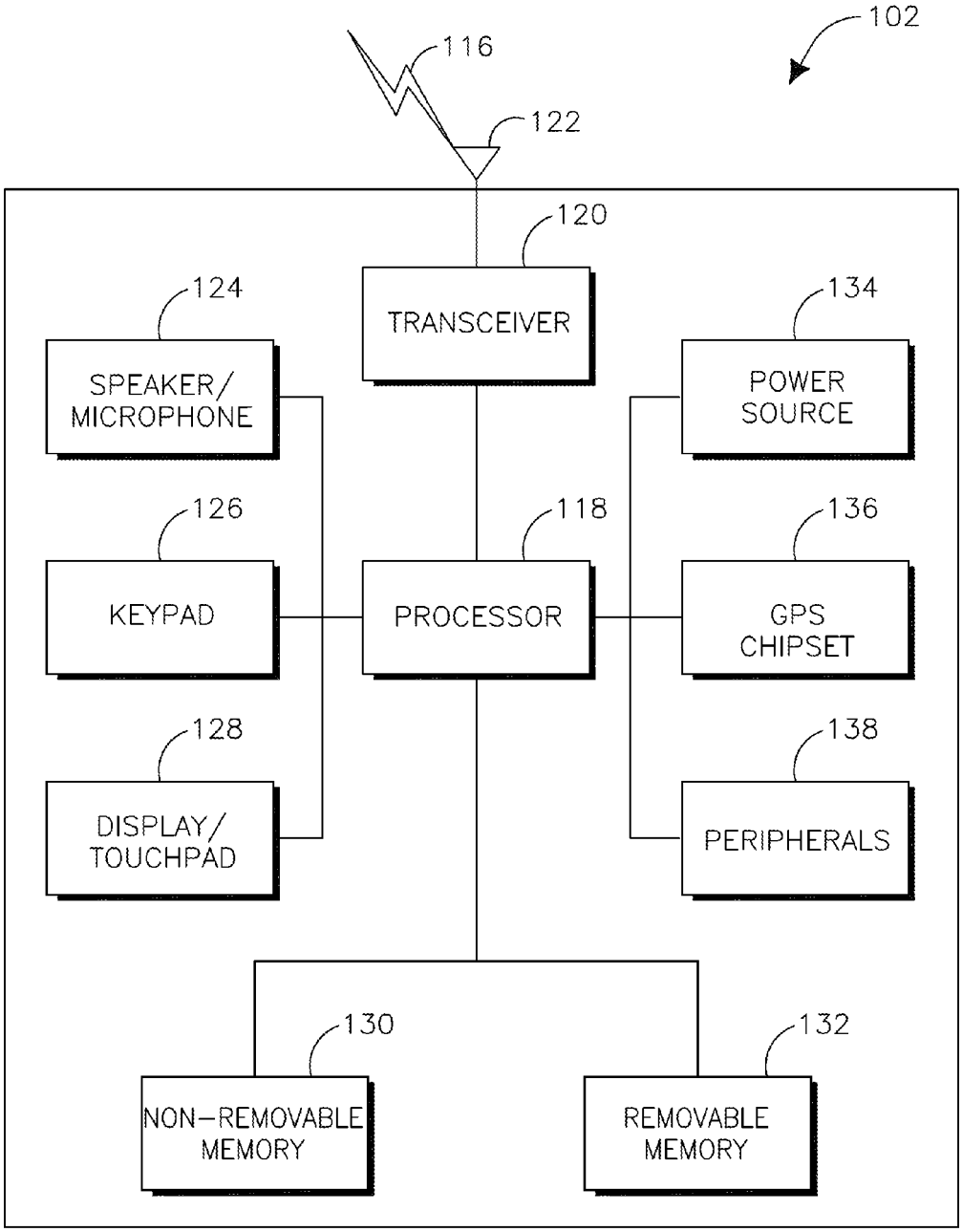
FIG. 1B is a system diagram of an example wireless transmit/receive unit (WTRU) that may be used within the communications system illustrated in FIG. 1A.

FIG. 1B is a system diagram of an example WTRU 102. As shown in FIG. 1B, the WTRU 102 may include a processor 118, a transceiver 120, a transmit/receive element 122, a speaker/microphone 124, a keypad 126, a display/ touchpad 128, non-removable memory 130, removable memory 132, a power source 134, a global positioning system (GPS) chipset 136, and other peripherals 138. It will be appreciated that the WTRU 102 may include any sub-combination of the foregoing elements while remaining consistent with an embodiment.

The processor 118 may be a general purpose processor, a special purpose processor, a conventional processor, a digital signal processor (DSP), a plurality of microprocessors, one or more microprocessors in association with a DSP core, a controller, a microcontroller, Application Specific Integrated Circuits (ASICs), Field Programmable Gate Array (FPGAs) circuits, any other type of integrated circuit (IC), a state machine, and the like. The processor 118 may perform signal coding, data processing, power control, input/output processing, and/or any other functionality that enables the WTRU 102 to operate in a wireless environment. The processor 118 may be coupled to the transceiver 120, which may be coupled to the transmit/receive element 122. While FIG. 1B depicts the processor 118 and the transceiver 120 as separate components, it will be appreciated that the processor 118 and the transceiver 120 may be integrated together in an electronic package or chip.

The transmit/receive element 122 may be configured to transmit signals to, or receive signals from, a base station (e.g., the base station 114*a*) over the air interface 116. For example, in one embodiment, the transmit/receive element 122 may be an antenna configured to transmit and/or receive RF signals. In another embodiment, the transmit/receive element 122 may be an emitter/detector configured to transmit and/or receive IR, UV, or visible light signals, for example. In yet another embodiment, the transmit/receive element 122 may be configured to transmit and receive both RF and light signals. It will be appreciated that the transmit/receive element 122 may be configured to transmit and/or receive any combination of wireless signals.

In addition, although the transmit/receive element 122 is depicted in FIG. 1B as a single element, the WTRU 102 may include any number of transmit/receive elements 122. More specifically, the WTRU 102 may employ MIMO technology. Thus, in one embodiment, the WTRU 102 may include two or more transmit/receive elements 122 (e.g., multiple antennas) for transmitting and receiving wireless signals over the air interface 116.

The transceiver 120 may be configured to modulate the signals that are to be transmitted by the transmit/receive element 122 and to demodulate the signals that are received by the transmit/receive element 122. As noted above, the WTRU 102 may have multi-mode capabilities. Thus, the transceiver 120 may include multiple transceivers for enabling the WTRU 102 to communicate via multiple RATs, such as UTRA and IEEE 802.11, for example.

The processor 118 of the WTRU 102 may be coupled to, and may receive user input data from, the speaker/microphone 124, the keypad 126, and/or the display/touchpad 128 (e.g., a liquid crystal display (LCD) display unit or organic light-emitting diode (OLED) display unit). The processor 118 may also output user data to the speaker/microphone 124, the keypad 126, and/or the display/touchpad 128. In addition, the processor 118 may access information from, and store data in, any type of suitable memory, such as the non-removable memory 130 and/or the removable memory 132. The non-removable memory 130 may include random-access memory (RAM), read-only memory (ROM), a hard disk, or any other type of memory storage device. The removable memory 132 may include a subscriber identity module (SIM) card, a memory stick, a secure digital (SD) memory card, and the like. In other embodiments, the processor 118 may access information from, and store data in, memory that is not physically located on the WTRU 102, such as on a server or a home computer (not shown).

The processor 118 may receive power from the power source 134, and may be configured to distribute and/or control the power to the other components in the WTRU 102. The power source 134 may be any suitable device for powering the WTRU 102. For example, the power source 134 may include one or more dry cell batteries (e.g., nickel-cadmium (NiCd), nickel-zinc (NiZn), nickel metal hydride (NiMH), lithium-ion (Li-ion), etc.), solar cells, fuel cells, and the like.

The processor 118 may also be coupled to the GPS chipset 136, which may be configured to provide location information (e.g., longitude and latitude) regarding the current location of the WTRU 102. In addition to, or in lieu of, the information from the GPS chipset 136, the WTRU 102 may receive location information over the air interface 116 from a base station (e.g., base stations 114*a*, 114*b*) and/or determine its location based on the timing of the signals being received from two or more nearby base stations. It will be appreciated that the WTRU 102 may acquire location information by way of any suitable location-determination method while remaining consistent with an embodiment.

The processor 118 may further be coupled to other peripherals 138, which may include one or more software and/or hardware modules that provide additional features, functionality and/or wired or wireless connectivity. For example, the peripherals 138 may include an accelerometer, an e-compass, a satellite transceiver, a digital camera (for photographs or video), a universal serial bus (USB) port, a vibration device, a television transceiver, a hands free headset, a Bluetooth® module, a frequency modulated (FM) radio unit, a digital music player, a media player, a video game player module, an Internet browser, and the like.

Figure 1C:
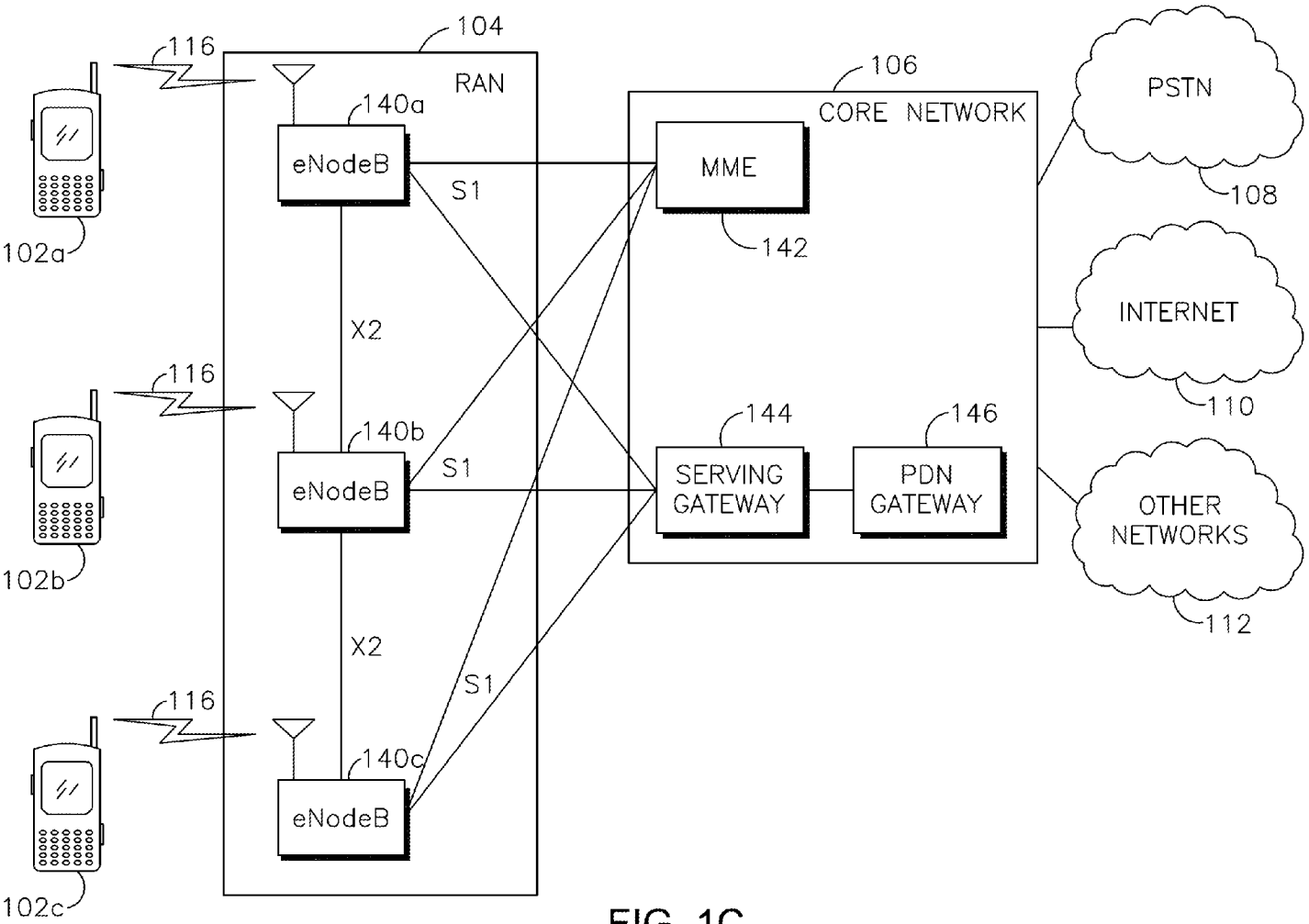
FIG. 1C is a system diagram of an example radio access network and an example core network that may be used within the communications system illustrated in FIG. 1A.

FIG. 1C is a system diagram of the RAN 104 and the core network 106 according to an embodiment. As noted above, the RAN 104 may employ an E-UTRA radio technology to communicate with the WTRUs 102*a*, 102*b*, 102*c* over the air interface 116. The RAN 104 may also be in communication with the core network 106.

The RAN 104 may include eNode-Bs 140*a*, 140*b*, 140*c*, though it will be appreciated that the RAN 104 may include any number of eNode-Bs while remaining consistent with an embodiment. The eNode-Bs 140*a*, 140*b*, 140*c* may each include one or more transceivers for communicating with the WTRUs 102*a*, 102*b*, 102*c* over the air interface 116. In one embodiment, the eNode-Bs 140*a*, 140*b*, 140*c* may implement MIMO technology. Thus, the eNode-B 140*a*, for example, may use multiple antennas to transmit wireless signals to, and receive wireless signals from, the WTRU 102*a*.

Each of the eNode-Bs 140*a*, 140*b*, 140*c* may be associated with a particular cell (not shown) and may be configured to handle radio resource management decisions, handover decisions, scheduling of users in the uplink and/or downlink, and the like. As shown in FIG. 1C, the eNode-Bs 140*a*, 140*b*, 140*c* may communicate with one another over an X2 interface.

The core network 106 shown in FIG. 1C may include a mobility management entity gateway (MME) 142, a serving gateway 144, and a packet data network (PDN) gateway 146. While each of the foregoing elements are depicted as part of the core network 106, it will be appreciated that any one of these elements may be owned and/or operated by an entity other than the core network operator.

The MME 142 may be connected to each of the eNode-Bs 140*a*, 140*b*, 140*c* in the RAN 104 via an S1 interface and may serve as a control node. For example, the MME 142 may be responsible for authenticating users of the WTRUs 102*a*, 102*b*, 102*c*, bearer activation/deactivation, selecting a particular serving gateway during an initial attach of the WTRUs 102*a*, 102*b*, 102*c*, and the like. The MME 142 may also provide a control plane function for switching between the RAN 104 and other RANs (not shown) that employ other radio technologies, such as GSM or WCDMA.

The serving gateway 144 may be connected to each of the eNode Bs 140*a*, 140*b*, 140*c* in the RAN 104 via the S1 interface. The serving gateway 144 may generally route and forward user data packets to/from the WTRUs 102*a*, 102*b*, 102*c*. The serving gateway 144 may also perform other functions, such as anchoring user planes during inter-eNode B handovers, triggering paging when downlink data is available for the WTRUs 102*a*, 102*b*, 102*c*, managing and storing contexts of the WTRUs 102*a*, 102*b*, 102*c*, and the like.

The serving gateway 144 may also be connected to the PDN gateway 146, which may provide the WTRUs 102*a*, 102*b*, 102*c* with access to packet-switched networks, such as the Internet 110, to facilitate communications between the WTRUs 102*a*, 102*b*, 102*c* and IP-enabled devices.

The core network 106 may facilitate communications with other networks. For example, the core network 106 may provide the WTRUs 102*a*, 102*b*, 102*c* with access to circuit-switched networks, such as the PSTN 108, to facilitate communications between the WTRUs 102*a*, 102*b*, 102*c* and traditional land-line communications devices. For example, the core network 106 may include, or may communicate with, an IP gateway (e.g., an IP multimedia subsystem (IMS) server) that serves as an interface between the core network 106 and the PSTN 108. In addition, the core network 106 may provide the WTRUs 102*a*, 102*b*, 102*c* with access to the networks 112, which may include other wired or wireless networks that are owned and/or operated by other service providers.

Any system employing infrastructure nodes may benefit from steering of narrow beam antennas, which without steering do not provide 360° coverage. Some solutions for increased or 360° coverage by antenna systems may suffer drawbacks. For example, if coverage is provided by multiple arrays or multiple fixed antennas, the cost may be driven up substantially. The overall node cost may be dominated by the number of radios or antenna chains, such that replication of these chains may not be a cost effective solution to increase coverage. Mechanical solutions may be lower cost than replication of radio frequency (RF) or antenna chains. However, mechanical solutions may need larger radomes (thus increasing other costs), may suffer greater reliability concerns as with any system with moving parts, and may hinder or eliminate any mesh system design that requires fast switching of antenna direction.

Methods which are used to control the direction and/or beam pattern using an array may exhibit issues with beam pattern control. One problem that arises from solutions which involve the modification of the beam pattern is the impact in incident impedance, which may affect the ability of an antenna array to control the beam shape optimally.

At high enough frequencies, the coverage issue may be addressed with quasi-optical techniques, including for 60 GHz systems where low cost, electrically steerable antennas are already a desirable part of low cost next generation devices, for example IEEE 802.11ad or Next Generation 60 GHz (NG60) devices. Such quasi-optical systems may be made using low cost materials, using low cost techniques and may easily fit access point (AP) and backhaul nodes.

Figure 2:
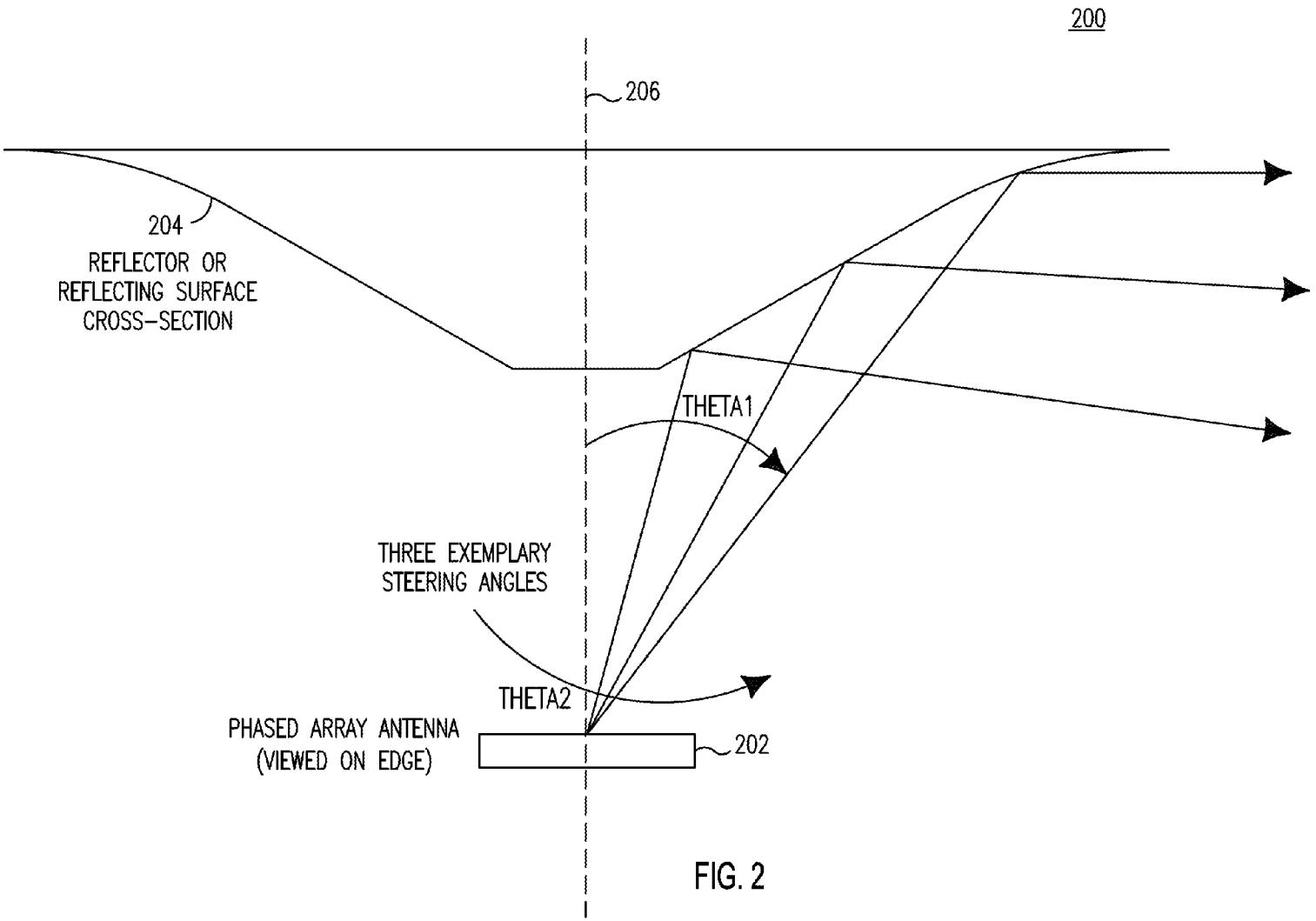
FIG. 2 shows a cross-sectional view of an example antenna system including a phased array antenna (PAA) and reflector that may be used within the communications system illustrated in FIG. 1A.

FIG. 2 shows a cross-sectional view of an example antenna system 200 including a phased array antenna (PAA) 202 and reflector 204, which is a reflecting surface shown on its cross-section. The antenna system 200 may be used within the communications system illustrated in FIG. 1A, for example.

An electrically steerable planar PAA 202 may be placed in fixed orientation, normal to the array surface, which is shown as pointing up in FIG. 2. Examples of an electrically steerable antenna include a rectangular array of patch antennas where each element in the array supports phase shifting at Radio Frequency/Intermediate Frequency/Local Oscillator/Analog Base Band/Binary Decision Diagram (RF/IF/LO/ABB/BDD).

A fixed reflector or reflecting surface 204 may be positioned in the local region of the PAA 202 such that the main lobe of the antenna may be steered to reflect off of different regions of the reflecting surface 204 so as to transform the beam direction, beam shape, or both.

For example, a reflector 204 of radial symmetry may be placed such that its normal or axis of rotation 206 is parallel to the array normal vector and intercepts the array at its center. All or part of the reflector 204 may be in the limited scan range of the PAA 202 (e.g. +/−45°) in each of two orthogonal directions from the normal, Theta1 and Theta2. For example, Theta1 may be declination from the normal vector and Theta2 may be rotation around the normal vector. The beam created by the PAA 202 may be pointed in the (Theta1, Theta2) direction. The PAA 202 may then reflect off the surface of the reflector 204. In the example of FIG. 2 (and under a quasi-optics assumption), the radial symmetry of the reflector 204 may imply that Theta2 maps directly into azimuth (Az), such that Az=Theta2. The elevation angle may be computed from the chosen cross-section profile of the reflector 204 and the distance from the PAA 202. For example, for a simple conical shape, the elevation angle=Theta1−2$\alpha$−180°, where $\alpha$ is the slope of the cone.

The beam is spread in azimuth due to the curvature of the reflector 204 around the axis of rotation 206. For low elevation angles, a smaller radius (i.e. higher curvature) portion of the reflector 204 may be illuminated. Thus, greater down-tilt angles may have wider beams with lower gain, which may be acceptable because greater down-tilt may imply the target WTRU is close to the base station. In this case, lower gain may be needed. Furthermore, there may be fewer WTRUs near the base station than far away, thus making competition for beams lower among these WTRUs.

For a conical shape, the beam may not spread in elevation. However, other profiles may be introduced to provide focusing or de-focusing of the beam in the elevation dimension as a function of elevation angle. For example, a concave-down reflector profile may be introduced, particularly at high elevation angles to provide increased gain for longer link distances. This concave downward shape is visible as a flaring out at the top portion of the cone in reflector 204.

In this way, the limited scan region {Theta1, Theta2} of the PAA 202 may be transformed to a azimuth-elevation coordinate system through the geometrical description of the reflecting surface. The coverage may be made to cover up to and including 360° in azimuth, sufficient scanning in elevation may be maintained, and beam shaping as a function of elevation can be introduced.

According to another embodiment, the reflector or reflecting surface may be retained as in the example of FIG. 2, but a mechanically steered antenna may be used instead of, or in addition to, an electrically steered antenna. While moving parts are still used in this case, the total travel of those parts may be reduced, which in turn may reduce beam steering time and radome size.

Figure 3A:
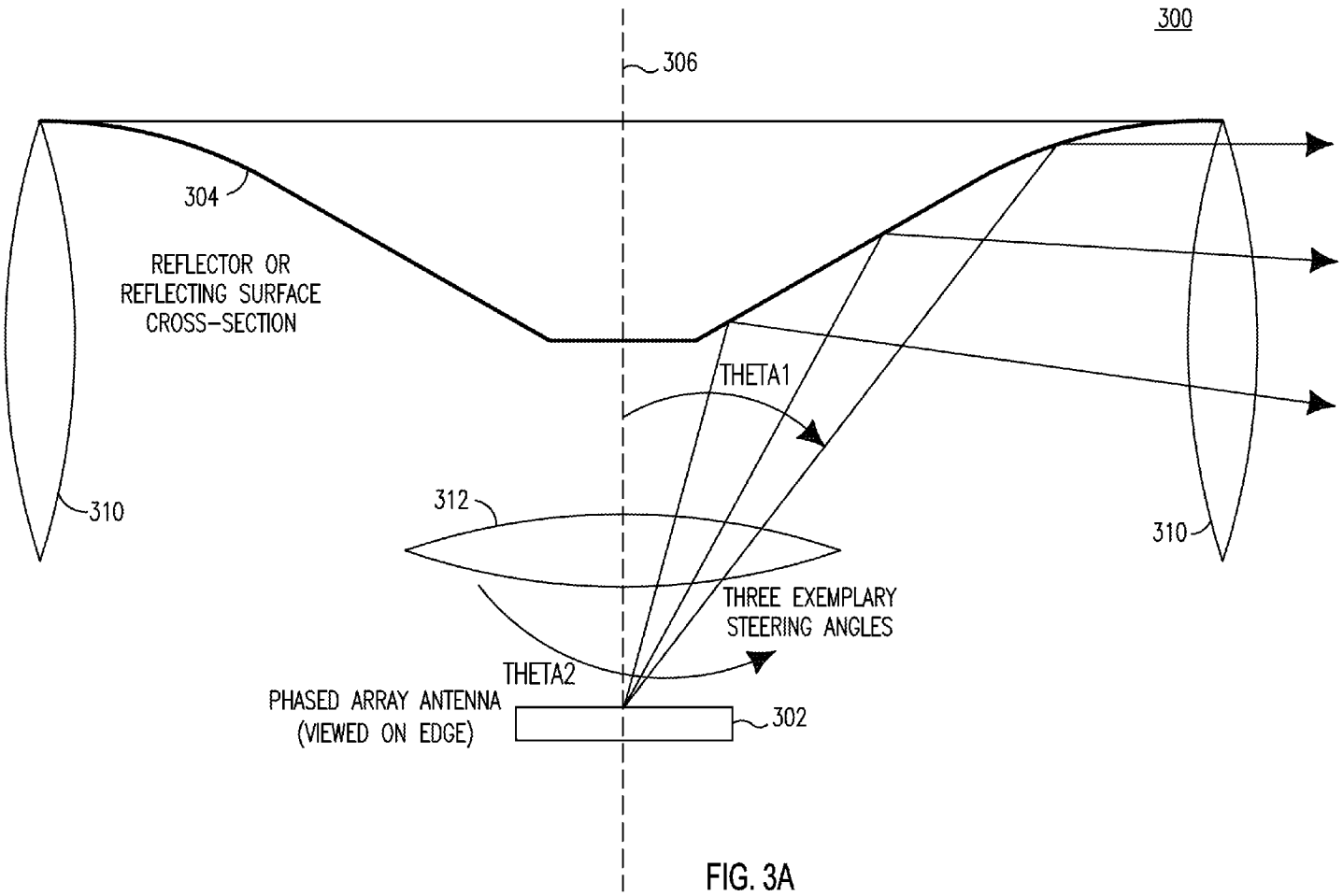
FIG. 3A shows a cross-sectional view of an example antenna system including a PAA and reflector with lenses that may be used within the communications system illustrated in FIG. 1A.
Figure 3B:
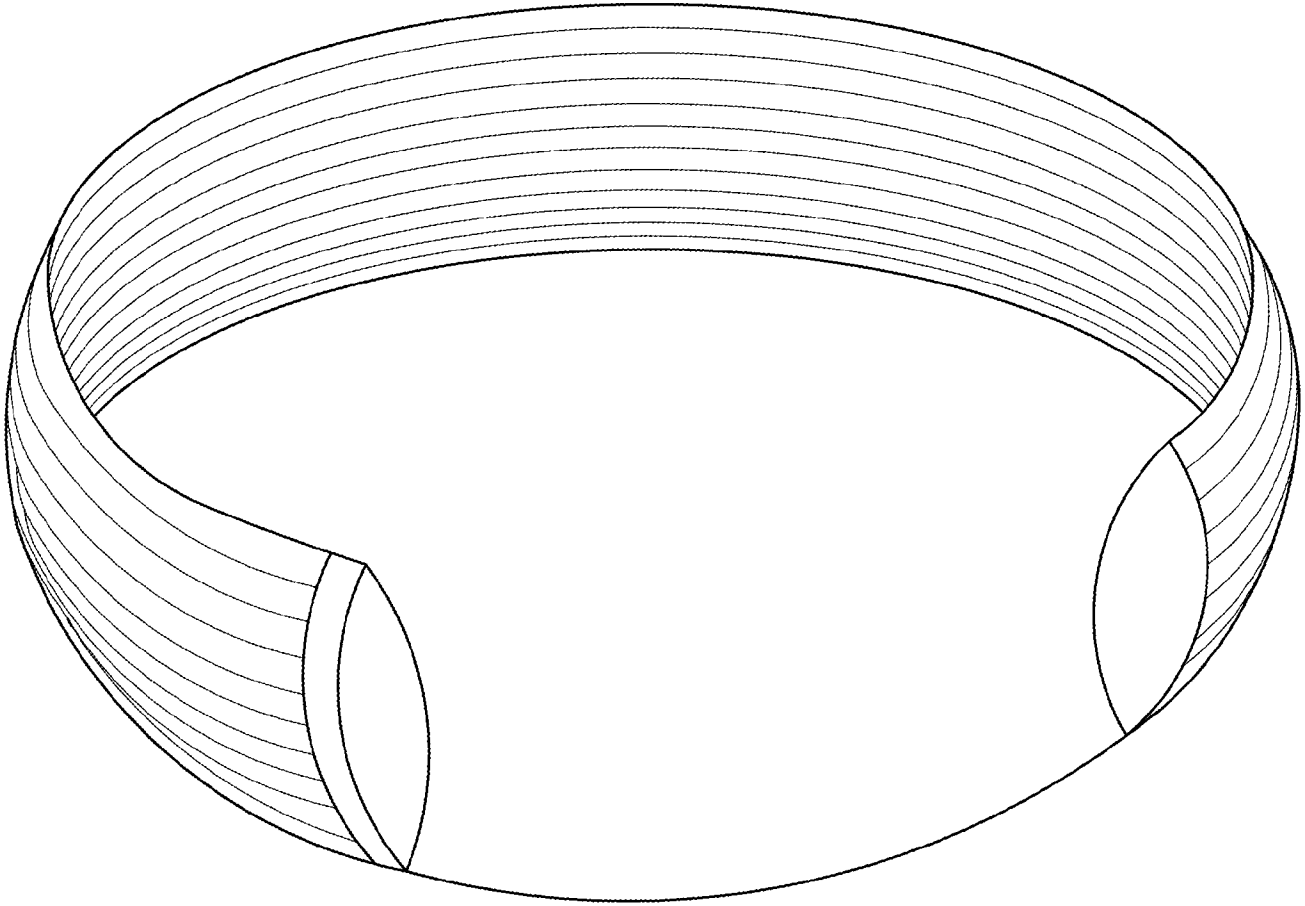
FIG. 3B shows a three-dimensional diagram of an example of a toroidal lens that can be used with the antenna system illustrated in FIG. 3A.

FIG. 3A shows a cross-sectional view of an example antenna system 300 including a PAA 302 and reflector 304 with lenses 310, 312, which may be used within the communications system illustrated in FIG. 1A. Lens 310 may be cross-sections of a single toroidal lens, for example the toroidal lens shown in FIG. 3B. In the example of FIG. 3A, one or more lenses 312 may be added between the PAA 302 and the reflector 304. The reflector 304 may be pyramidal, have radial symmetry, and/or one or more lenses 312 positioned near the reflector 304 where the propagating waves emerge. The example in FIG. 3 shows one lens 312 between the reflector 304 and the PAA 302, although any number of lenses may be used. Such lenses 312 may be useful for aligning the scan range of the PAA 302 with the solid angle projected by the reflector 304, thus maximizing the antenna gain for the given reflector 304, or for chromatic corrections.

Beams near the normal 306 to the PAA 302 may be unused in the example of FIG. 3A, and the lens 312 may be shaped to map some of the antenna steering direction near the normal 306 to points further from the normal 306, thus creating a greater density of usable steering directions.

Further, one or more toroidal lenses 310 may be positioned around an outer perimeter of the reflector 304. This may help to shape the beam as function of elevation, and may also provide a mounting surface for the reflector 304. The lens placements and lens shapes shown in FIG. 3A are exemplary, such that the actual lens shape(s) and/or arrangements may differ and/or be more complicated.

Figure 4:
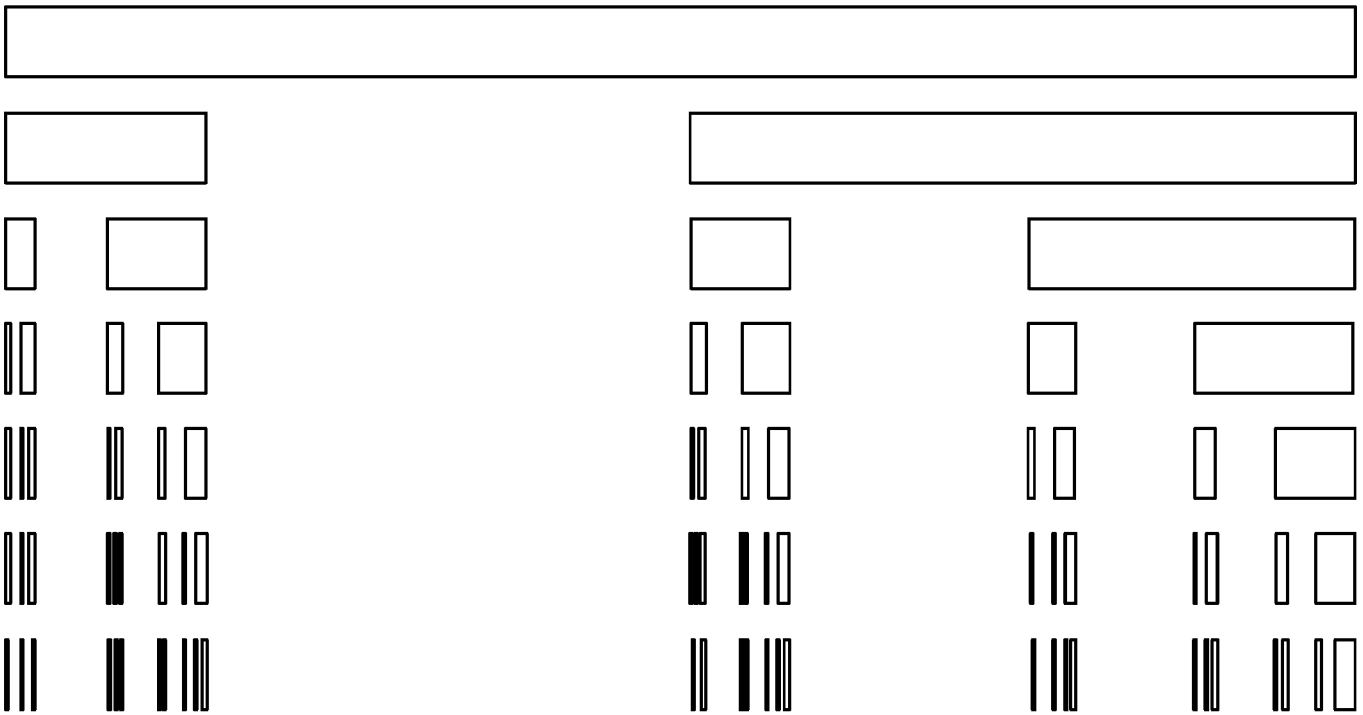
FIG. 4 shows a planar view of an example meta-material reflecting surface pattern constructed using a Cantor Set, which may be used in the systems of any of the previous figures.
Figure 5:
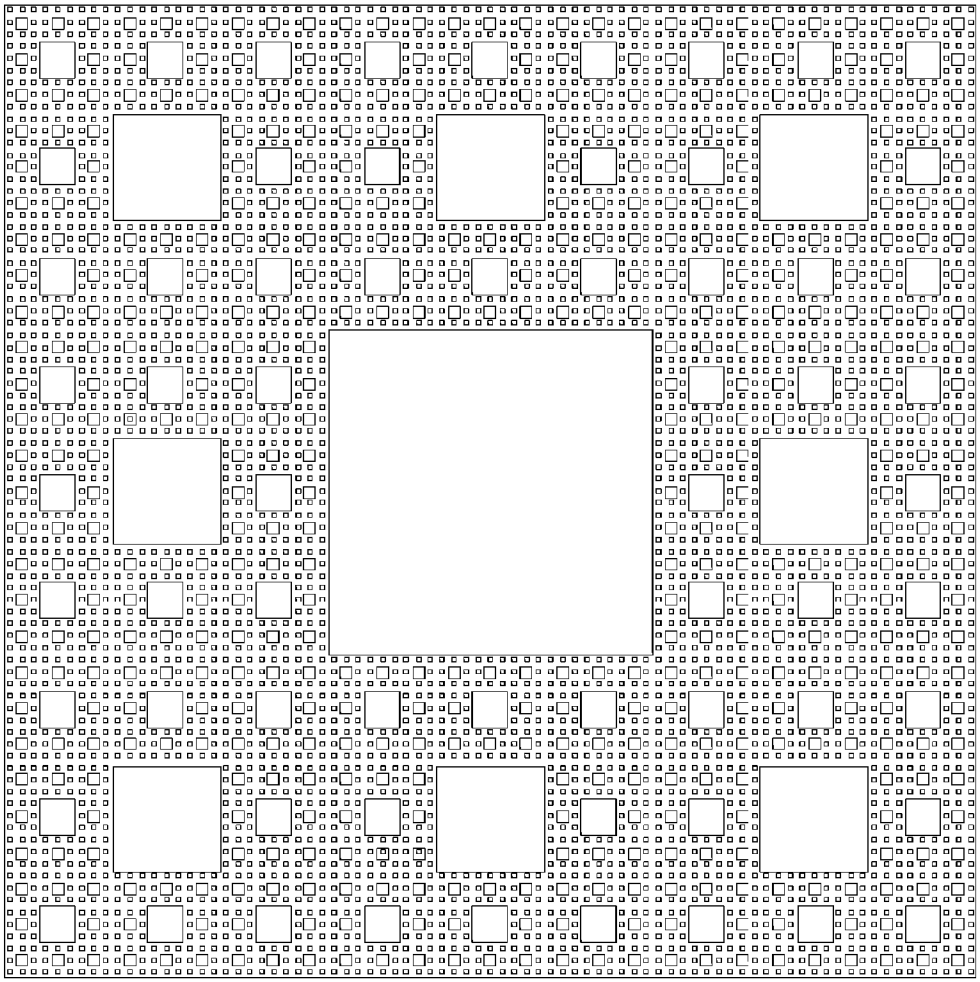
FIG. 5 shows a planar view of an example meta-material reflecting surface pattern constructed using the Sierpinski Carpet, which may be used in the systems of any of the previous figures.
Figure 6:
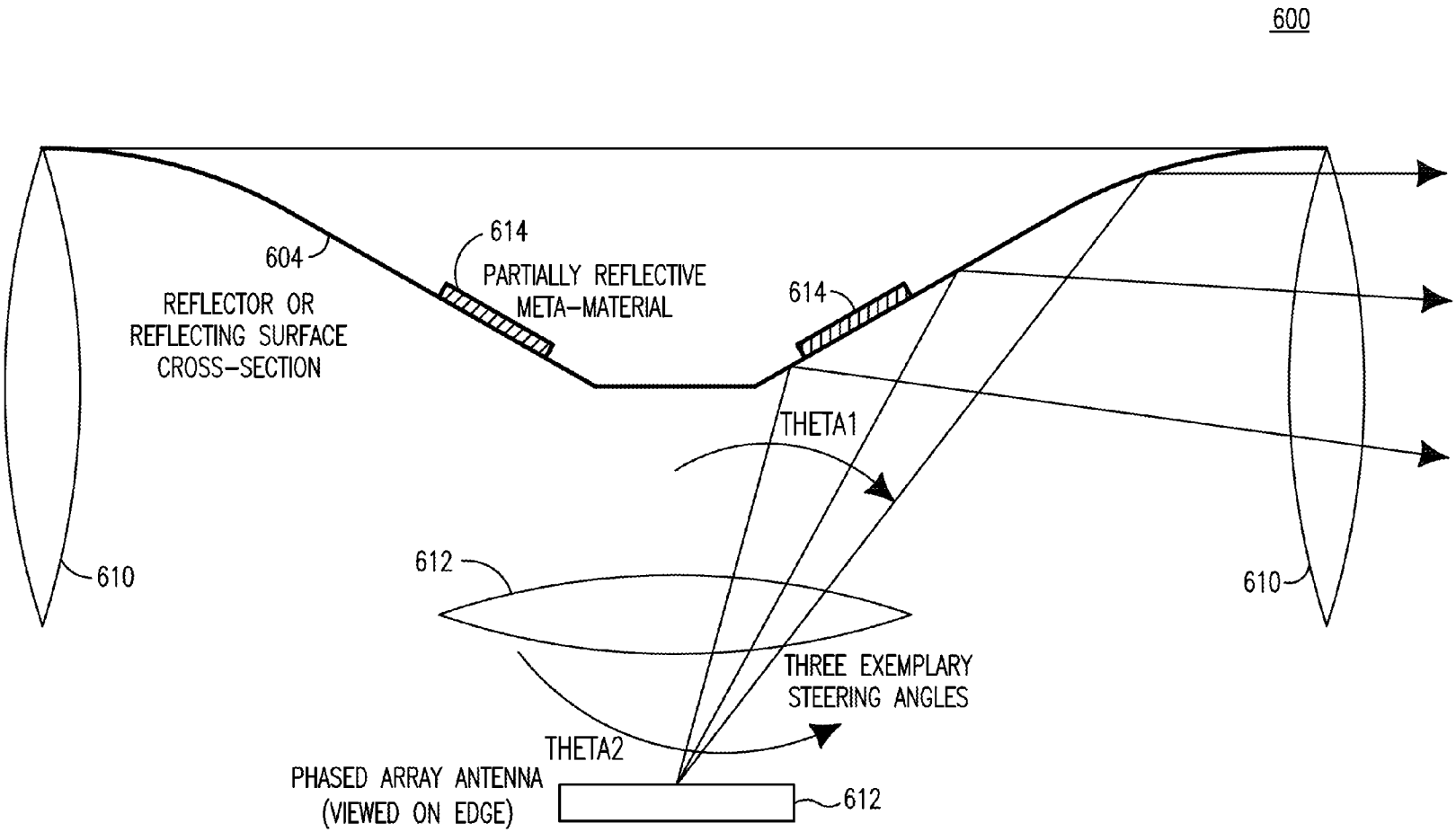
FIG. 6 shows a cross-sectional view of an example antenna system including a PAA, a reflector using meta-material and including lenses that may be used within the communications system illustrated in FIG. 1A.

As addressed herein, control of antenna beam direction and/or pattern using an array may give rise to issues with beam pattern control and antenna freespace impedance. When using a reflecting surface or reflector, the freespace impedance may be controlled in order to enable the array to adequately control the beam pattern shape. FIGS. 4, 5, and 6 relate to a reflecting surface that uses or incorporates a meta-material, which allows the reflecting surface to either modify the incident freespace impedance, and/or the beam pattern refinement. Active and/or passive approaches for a reflecting surface that is based on a meta-material may be used.

A passive meta-material may be constructed by appropriate milling of the reflective surface. Examples of meta-material surfaces constructed in this way include the fractal patterns on the surface are shown in FIGS. 4 and 5. FIG. 4 shows a planar view of an example meta-material reflecting surface pattern constructed using a Cantor Set, which may be used in the systems of any of the previous figures. FIG. 5 shows a planar view of an example meta-material reflecting surface pattern constructed using the Sierpinski Carpet, which may be used in the systems of any of the previous figures.

In another approach for the construction of a meta-material reflector, a suitable introduction of voids and/or gaps may be added to the surface. Using this method, the shape of the reflected beam may be modified by altering the meta-material characteristics as a function of the angle from normal to the PAA surface. A passive meta-material may be either partially reflective, and/or exhibit frequency dependent characteristics. Frequency dependent characteristics of a meta-material are possible through the use of an anisotropic material for the meta-material. Examples of anisotropic materials include dielectrics which exhibit magnetic permittivity and/or permeability.

The focusing ability of a reflector is typically controlled by the appropriate use of a parabolic shape in the reflector. However, it may be difficult to accurately control this shape for use at millimeter wave (mmW) or quasi-optical frequencies. The use of a partially reflective meta-material in the reflector may be used to control and/or refine the transmitted beam shape of the reflector.

FIG. 6 shows a cross-sectional view of an example antenna system 600 including a PAA 602, a reflector 604 using meta-material 614 and including lenses 610, 612, which may be used within the communications system illustrated in FIG. 1A. In the example of FIG. 6, a partially reflective meta-material 614 may be used in the portion closest to the source, having the effect of defocusing, focusing, or altering the beam of the reflected wave in that portion of the reflecting surface 604.

The frequency characteristics of a planar array, such as PAA 602, may exhibit frequency response dependence with the offsite bore angle of the transmission (e.g. Theta1). The dependence with the bore site angle may be exacerbated by the introduction of a reflector 604. The introduction of a meta-material 614 in the reflector 604 may be used to compensate for this dependence. Use of an anisotropic material would allow further control of the frequency dependence in this case. Although not shown in FIG. 6, the meta-materials described herein may be used for any of the lenses 610, 612 either instead of, or in addition to, the use of meta-material 614 in the reflector 604.

The benefits of using a passive meta-material for the reflector may be extended by the use of an active meta-material either in place of, or in addition to, the passive meta-material. An active meta-material may allow the characteristics of the meta-material to be modified using an external control of the negative-permeability. As discussed above, a partially reflective meta-material applied to only a portion of the reflector may allow control of the reflected beam. A similar effect may be achieved using an active meta-material applied to the entire reflective surface, where the meta-material properties may be controlled over different portions of the reflective surface.

The quasi-optical systems described above may be further enhanced to be adjustable to the environment in which they are deployed. For example, different coverage angles may be desired in a room with a low versus a high ceiling, or in a conference room versus concert hall, or a home backhaul versus an access link application. The shapes of the components in the system may be adjusted to achieve the different coverage angles. For example, a cone with a slit cut into it from apex to edge may be made to have different angle apex, and different base circumference, by use of a tensioning screw from apex to base and allowing the cone to wind or unwind around itself. Additionally, the system may have interchangeable components to match the scenario, for example, one lens may be replaced by another or removed altogether.

For sufficiently large wavelengths, lens-like structures may be created from dielectric materials with features much smaller than a wavelength. Under these conditions, the effective dielectric constant of such a structure may be controlled. One example of such a structure is a Luneburg lens that may be constructed of a single dielectric material such that the dielectric constant is manipulated by a local amount of material deposited in a three-dimensional (3D) printing process (e.g. using additive process machining).

Figure 7:
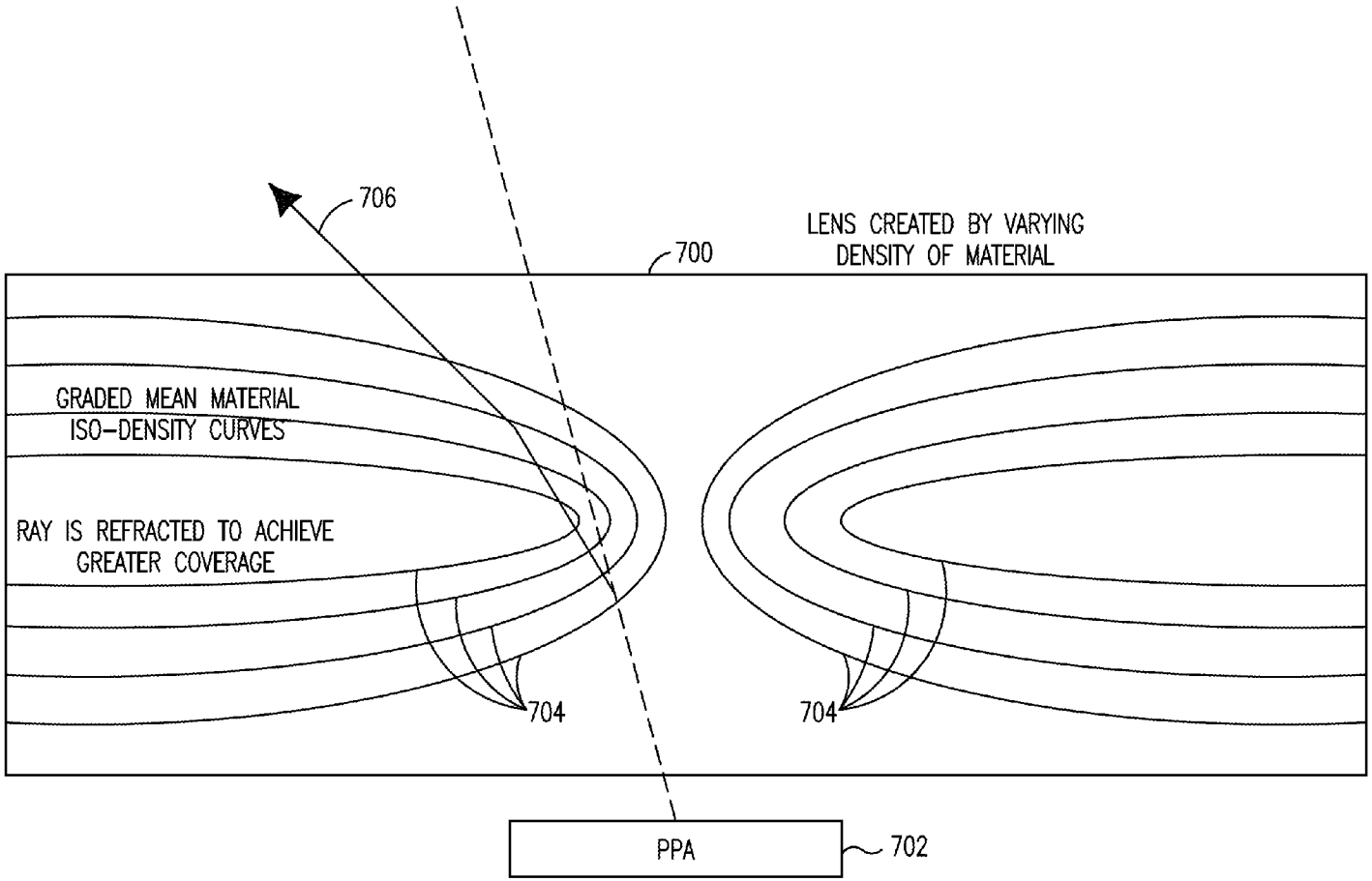
FIG. 7 shows a cross-sectional view of an example lens created using a varying density material.

In another example, a lens of varying refraction index may be created to provide enhanced coverage rather than focusing. FIG. 7 shows a cross-sectional view of an example lens 700 created using a varying density and/or index of refraction material. The lens 700 may include macroscopic graded index that may be achieved, for example, by control of small scale material density in additive process machining, e.g., by including small voids in the bulk material. The ellipses 704 illustrate an example graded mean material. The lines are iso-density curves used to indicate a gradual gradient change in the index of refraction or dielectric constant. The varying-density lens 700 produces the bending effect on the ray 706 from PAA 702, which may be used to provide increased coverage. Lens structures such as the structure of lens 700 with near continuous changes in index may be more efficient than a lenses with discontinuous change in index.

While the embodiments described herein pertain to a transmitting antenna, the same principal may be applied to receiving antennas and antennas that switch between transmitting (Tx) and receiving (Rx). Furthermore, multiple antennas, which may be any mixture of Tx and/or Rx antennas and different operating frequencies, may share the same reflector although in this case the multiple antennas may not be placed too far from the axis of rotation of the reflector and/or may not have coverage requirements that are too dissimilar.

For any of the embodiments described herein, PAAs may be placed such that the normal to the PAA is not parallel to the axis of rotation of the reflector, for example to emphasize a particular azimuth direction. Additionally, the reflector may not be complete, where the reflector may be cut such that it does not make a full rotation about its axis.

Figure 8:
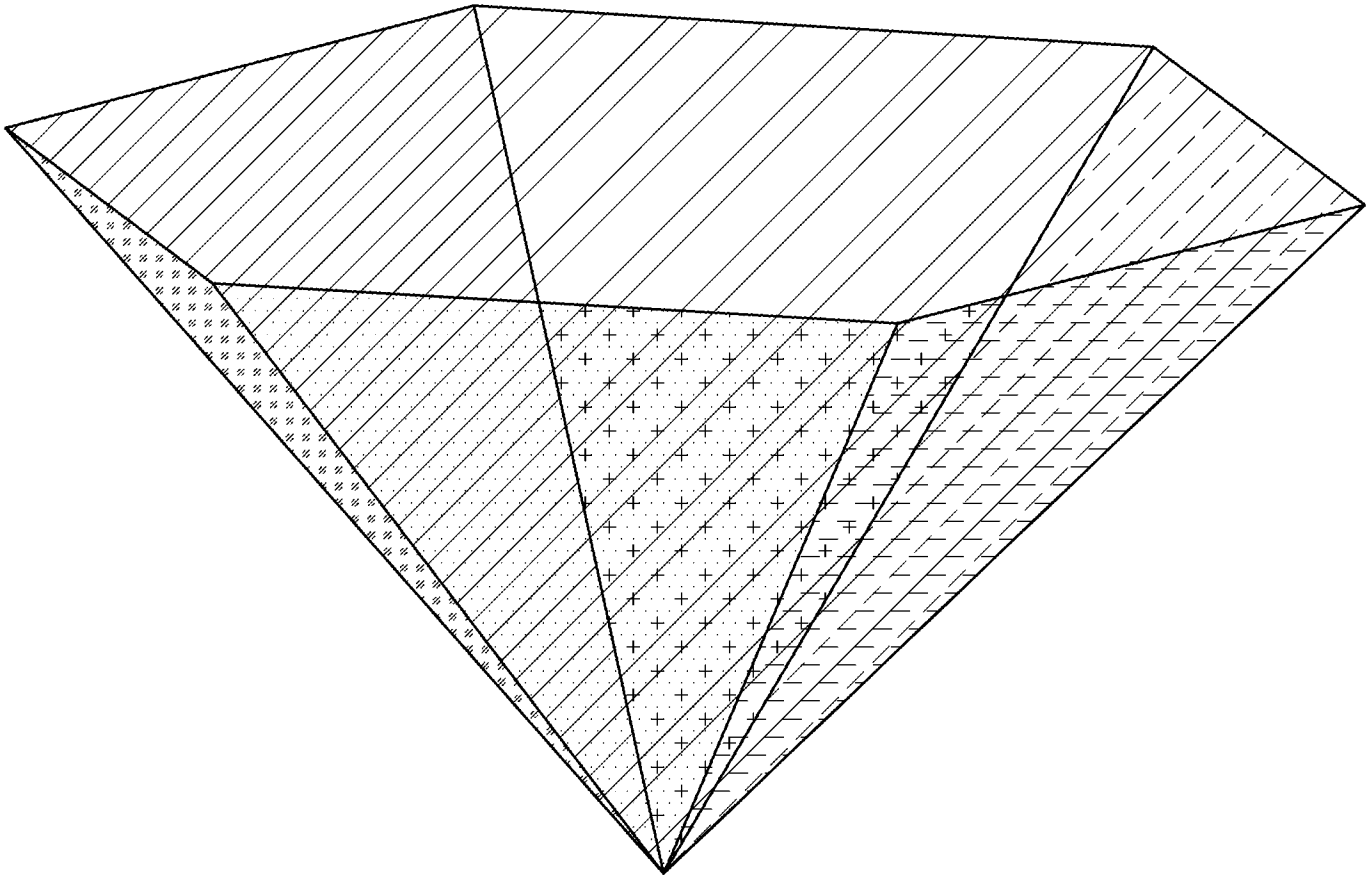
FIG. 8 is a perspective view of a hexagonal pyramid reflector that may be used within the communications system illustrated in FIG. 1A.

For any of the embodiments described herein, the reflector may not have radial symmetry and/or there may be separate reflectors. For example, a separate reflector may cover 180 degrees for each of two PAAs. This may simplify certain aspects of the design of the reflector and may permit greater separation of antennas, for example. Furthermore, such a reflector may extend to the base between the PAAs thus providing enough shielding to permit simultaneous Tx and Rx (i.e. full duplex) operation. Examples of such non-radial symmetry could include faceted surfaces such as the hexagonal pyramid reflector shown in FIG. 8, or collections of other surfaces.

For PAAs with vertical and/or horizontal polarization, the polarization of the resulting propagating wave may have dependence on pointing direction. When using multiple such PAAs, a different PAA may be assigned to be used for different directions depending on the desired polarity. Furthermore, a PAA may be able to manipulate the polarization to compensate for any effective change in the polarization versus the direction of the resulting beam, and/or circular polarization may be used.

Although features and elements are described above in particular combinations, one of ordinary skill in the art will appreciate that each feature or element can be used alone or in any combination with the other features and elements. In addition, the methods described herein may be implemented in a computer program, software, or firmware incorporated in a computer-readable medium for execution by a computer or processor. Examples of computer-readable media include electronic signals (transmitted over wired or wireless connections) and computer-readable storage media. Examples of computer-readable storage media include, but are not limited to, a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs). A processor in association with software may be used to implement a radio frequency transceiver for use in a WTRU, UE, terminal, base station, RNC, or any host computer.

What is claimed:

1. A millimeter wave (mmW) antenna system comprising:

a steerable planar antenna configured to produce a narrow beam with a scan range of less than 360 degree coverage;

a reflector configured to be positioned locally to the steerable planar antenna and at least partially within the scan range of the steerable planar antenna, wherein the reflector has a concave-down profile; and the steerable planar antenna configured to be steered to point the narrow beam to reflect off different regions of the reflector to spread the narrow beam in azimuth to provide 360 degree coverage.

2. The mmW antenna system of claim 1, wherein the planar antenna is an electrically steerable antenna.

3. The mmW antenna system of claim 1, wherein the planar antenna is a mechanically steerable antenna.

4. The mmW antenna system of claim 1, wherein the scan range is less than 90 degrees.

5. The mmW antenna system of claim 1, wherein the steerable planar antenna is a phased array antenna (PAA).

6. The mmW antenna system of claim 1, wherein the reflector is a fixed reflector.

7. The mmW antenna system of claim 1, wherein the reflector has radial symmetry.

8. The mmW antenna system of claim 1, wherein an axis of rotation of the reflector is parallel to a normal vector of the steerable planar antenna and intercepts the steerable planar antenna at its center.

9. The mmW antenna system of claim 1, further comprising:

at least one lens in between the steerable planar antenna and the reflector configured to align the scan range of the steerable planar antenna with a solid angle projected by the reflector.

10. The mmW antenna system of claim 9, wherein the at least one lens maps the narrow beam directed near a normal vector of the steerable planar antenna to points further away from the normal vector of the steerable planar antenna.

11. The mmW antenna system of claim 9, wherein the at least one lens has radial symmetry.

12. The mmW antenna system of claim 1, further comprising:

at least one lens around a perimeter of the reflector configured to align the scan range of the planar antenna for the reflector.

13. The mmW antenna system of claim 1 further comprising:

meta-material positioned on the reflector configured to modify a freespace impedance.

14. The mmW antenna system of claim 13, wherein the meta-material is further configured to refine a beam pattern of the narrow beam.

15. The mmW antenna system of claim 13, wherein the meta-material has a surface with a fractal pattern.

16. The mmW antenna system of claim 13, wherein the meta-material includes gaps for shaping the narrow beam reflecting off the reflector.

17. The mmW antenna system of claim 1, wherein the scan range of the narrow beam is extended in azimuth.

18. The mmW antenna system of claim 1, wherein the scan range of the narrow beam is extended in elevation.

19. The mmW antenna system of claim 1, wherein the scan range of the narrow beam is extended in both azimuth and elevation.

20. The mmW antenna system of claim 1 configured as a quasi-optical antenna system.

* * * * *